US010564556B2

(12) United States Patent
Kunisawa

(10) Patent No.: US 10,564,556 B2
(45) Date of Patent: Feb. 18, 2020

(54) ELECTROPHOTOGRAPHIC PHOTORECEPTOR, PROCESS CARTRIDGE, AND IMAGE FORMING APPARATUS

(71) Applicant: FUJI XEROX CO., LTD., Tokyo (JP)

(72) Inventor: Eri Kunisawa, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/946,312

(22) Filed: Apr. 5, 2018

(65) Prior Publication Data

US 2019/0094724 A1 Mar. 28, 2019

(30) Foreign Application Priority Data

Sep. 27, 2017 (JP) ..... 2017-186883

(51) Int. Cl.
*G03G 5/06* (2006.01)
*G03G 5/05* (2006.01)

(52) U.S. Cl.
CPC ..... *G03G 5/0696* (2013.01); *G03G 5/0514* (2013.01); *G03G 5/0542* (2013.01); *G03G 2215/00957* (2013.01)

(58) Field of Classification Search
CPC ..... G03G 5/047; G03G 5/0525; G03G 5/0517
See application file for complete search history.

(56) References Cited

U.S. PATENT DOCUMENTS 5,298,617 A 3/1994 Nukada et al.
5,302,479 A 4/1994 Daimon et al.
5,378,569 A 1/1995 Nukada et al.
5,459,004 A 10/1995 Katsumi et al.
5,853,931 A 12/1998 Yamamoto
6,020,426 A * 2/2000 Yamaguchi ..... C08F 257/02 430/127
7,276,318 B2 10/2007 Fujii et al.
7,517,626 B2 4/2009 Fujii et al.
2003/0190540 A1 * 10/2003 Shoshi ..... C07D 209/58 430/78

FOREIGN PATENT DOCUMENTS

JP 04-189873 A 7/1992
JP 05-098181 A 4/1993
JP 05-140472 A 6/1993
JP 05-140473 A 6/1993
JP 05-263007 A 10/1993
JP 05-279591 A 10/1993
JP 09-311477 A 12/1997
JP 2003-173034 A 6/2003
(Continued)

OTHER PUBLICATIONS

Translation of JP 2005-266071 published Sep. 2005.*

*Primary Examiner* — Peter L Vajda
(74) *Attorney, Agent, or Firm* — Sughrue Mion, PLLC

(57) ABSTRACT

An electrophotographic photoreceptor includes a conductive substrate, a charge-generating layer disposed on the conductive substrate, and a charge-transporting layer as an outermost layer disposed on the charge-generating layer and containing a binder resin and a charge-transporting material, wherein the average particle size of the crystal of the charge-transporting material is approximately from 0.1 μm to 5.0 μm.

14 Claims, 3 Drawing Sheets

(56) References Cited

FOREIGN PATENT DOCUMENTS

| | | | | | |
|---|---|---|---|---|---|
| JP | 2004-078147 | A | | 3/2004 | |
| JP | 2005-181992 | A | | 7/2005 | |
| JP | 2005-266071 | | * | 9/2005 | ..... G03G 5/05 |
| JP | 2009-198879 | A | | 9/2009 | |
| JP | 2012-155282 | A | | 8/2012 | |

* cited by examiner

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2017-186883 filed Sep. 27, 2017.

BACKGROUND

(i) Technical Field

The present invention relates to an electrophotographic photoreceptor, a process cartridge, and an image forming apparatus.

(ii) Related Art

In well-known typical electrophotographic image forming apparatuses, an electrophotographic photoreceptor is used; and processes of charging, forming an electrostatic latent image, development, transfer, and cleaning are performed in sequence.

Known electrophotographic photoreceptors are functionally-separated photoreceptors in which a charge-generating layer and a charge-transporting layer are laminated so as to overlie a conductive substrate, such as an aluminum substrate, and single-layer photoreceptors in which a single layer serves to generate charges and to transport the charges.

SUMMARY

According to an aspect of the invention, there is provided an electrophotographic photoreceptor including a conductive substrate, a charge-generating layer disposed on the conductive substrate, and a charge-transporting layer as an outermost layer disposed on the charge-generating layer and containing a binder resin and a charge-transporting material, wherein the average particle size of the crystal of the charge-transporting material is approximately from 0.1 μm to 5.0 μm.

BRIEF DESCRIPTION OF THE DRAWINGS

Exemplary embodiments of the present invention will be described in detail based on the following figures, wherein.

DETAILED DESCRIPTION

Figure 1:
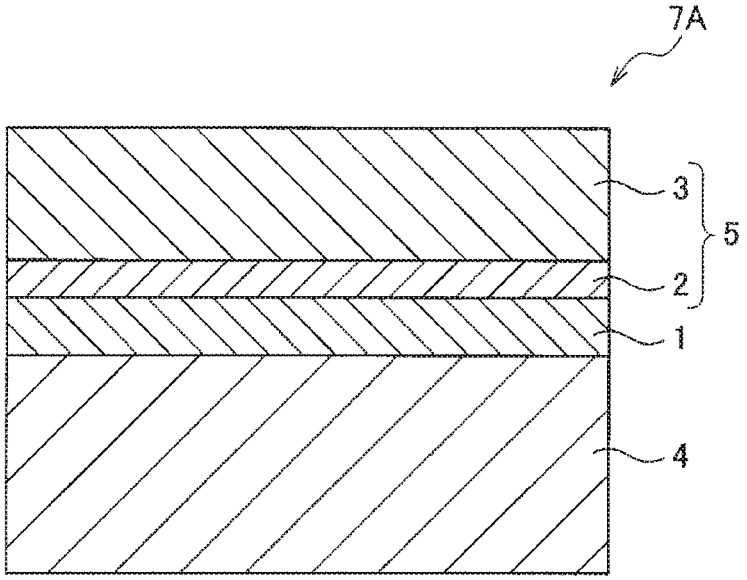
FIG. 1 is a schematic cross-sectional view partially illustrating an example of the layered structure of an electrophotographic photoreceptor according to a first exemplary embodiment.

Exemplary embodiments of the invention will now be described with reference to the drawings. In the drawings, parts having the same function are denoted by the same reference sign, and repeated description thereof is omitted.

Electrophotographic Photoreceptor

An electrophotographic photoreceptor (also referred to as "photoreceptor") according to a first exemplary embodiment includes a conductive substrate, a charge-generating layer disposed on the conductive substrate, and a charge-transporting layer as the outermost layer disposed on the charge-generating layer.

The charge-transporting layer contains a binder resin and a charge-transporting material, and the crystals of the charge-transporting material have an average particle size ranging approximately from 0.1 μm to 5.0 μm.

The electrophotographic photoreceptor is, for example, used in contact with a contact-type charging unit (such as charging roller) or cleaning unit (such as cleaning blade) under pressure (also referred to as "nip pressure"). The charge-transporting layer, which is the outermost layer of the electrophotographic photoreceptor, is therefore likely to be continuously worn. If the hardness of the charge-transporting layer as the outermost layer is enhanced to avoid the wear, the nip pressure causes the charge-transporting layer to be cracked in some cases.

The photoreceptor having the above-mentioned structure according to the first exemplary embodiment enables reductions in the wear of the charge-transporting layer as the outermost layer and in the occurrence of the cracks. The mechanism thereof is speculated as follows.

The crystals of the charge-transporting material have a high hardness. When the crystals of the charge-transporting material with high hardness are grown to the above-mentioned average particle size in the charge-transporting layer, the surface of the charge-transporting layer has scattered regions of high hardness. In other words, the hardness of the surface of the charge-transporting layer is partially enhanced. The regions of high hardness on the charge-transporting layer consequently serve for a reduction in the wear of the layer. The crystals of the charge-transporting material have been dispersed in the charge-transporting layer, and regions other than the regions of crystal are therefore easy to be deformed even under nip pressure, which makes the charge-transporting layer hard to be cracked.

In the photoreceptor of the first exemplary embodiment, such a mechanism is presumed to enable reductions in the wear of the charge-transporting layer as the outermost layer and in the occurrence of cracks.

The photoreceptor of the first exemplary embodiment may be a single-layer photoreceptor having a single-layer photosensitive layer. In the single-layer photoreceptor, the single-layer photosensitive layer contains a binder resin, a charge-generating material, and a charge-transporting material; and the crystals of the charge-transporting material have an average particle size ranging approximately from 0.1 m to 5.0 μm.

In the photoreceptor of the first exemplary embodiment in the form of the single-layer photoreceptor having such a structure, the wear of the single-layer photosensitive layer as the outermost layer and the occurrence of cracks are also reduced.

The electrophotographic photoreceptor of the first exemplary embodiment will now be described with reference to the drawings.

FIG. 1 is a schematic cross-sectional view partially illustrating an example of the layered structure of an electrophotographic photoreceptor 7A according to the first exemplary embodiment. The electrophotographic photoreceptor 7A illustrated in FIG. 1 has a structure in which an undercoat layer 1, a charge-generating layer 2, and a charge-transporting layer 3 are overlying a conductive substrate 4 in sequence. The charge-generating layer 2 and the charge-transporting layer 3 serve as a photosensitive layer 5.

The electrophotographic photoreceptor 7A may have a structure in which the undercoat layer 1 is not provided. The electrophotographic photoreceptor 7A may have a single-layer photosensitive layer in which the charge-generating layer 2 and the charge-transporting layer 3 are functionally integrated.

The parts of the electrophotographic photoreceptor will now be described. The reference sings of the parts are omitted in the following description.

Conductive Substrate

Examples of the conductive substrate include metal plates, metal drums, and metal belts containing metals (such as aluminum, copper, zinc, chromium, nickel, molybdenum, vanadium, indium, gold, and platinum) or alloys (such as stainless steel). Other examples of the conductive substrate include paper, resin films, and belts each having a coating film formed by applying, depositing, or laminating conductive compounds (such as conductive polymers and indium oxide), metals (such as aluminum, palladium, and gold), or alloys. The term "conductive" herein refers to having a volume resistivity that is less than $10^{13}$ Ωcm.

In the case where the electrophotographic photoreceptor is used in a laser printer, the surface of the conductive substrate is suitably roughened to a center line average roughness Ra ranging from 0.04 μm to 0.5 μm in order to reduce interference fringes generated on radiation of laser light. The roughening for the reduction in interference fringes does not need to be performed when incoherent light is emitted from a light source; however, roughening the surface of the conductive substrate reduces generation of the defect thereof, which leads to prolonged product lifetime.

Examples of a technique for the roughening include wet honing in which an abrasive is suspended in water and then sprayed to the conductive substrate, centerless grinding in which a rotating grindstone is pressed against the conductive substrate to continuously grind it, and anodic oxidation.

Another roughening technique may be used; for instance, conductive or semi-conductive powder is dispersed in resin, the layer thereof is formed on the surface of the conductive substrate, and the particles dispersed in the layer serve for the roughening without directly roughening the surface of the conductive substrate. The roughening may be performed for the undercoat layer that will be described later.

In the roughening by anodic oxidation, a conductive substrate formed of metal (e.g., aluminum) serves as an anode for the anodic oxidation in an electrolyte solution, thereby forming an oxidation film on the surface of the conductive substrate. Examples of the electrolyte solution include a sulfuric acid solution and an oxalic acid solution. A porous anodic oxidation film formed by anodic oxidation is, however, chemically active in its original state; thus, it is easily contaminated and suffers a great change in resistance depending on environment. Accordingly, the pores of the porous anodic oxidation film are suitably closed owing to volume expansion resulting from a hydration reaction in pressurized steam or in boiled water (metal salt such as nickel is optionally added) to turn the oxidation film to more stable hydrous oxide.

The thickness of the anodic oxidation film is, for example, suitably from 0.3 μm to 15 μm. At a thickness in such a range, barrier properties to injection are likely to be given, and an increase in the residual potential due to repeated use is likely to be reduced.

The conductive substrate is optionally subjected to a treatment with an acidic treatment liquid or a boehmite treatment.

An example of the treatment with an acidic treatment liquid is as follows. An acidic treatment liquid containing a phosphoric acid, a chromic acid, and a hydrofluoric acid is prepared. The amounts of the phosphoric acid, chromic acid, and hydrofluoric acid in the acidic treatment liquid are, for instance, in the range of 10 mass % to 11 mass %, 3 mass % to 5 mass %, and 0.5 mass % to 2 mass %, respectively; the total concentration of the whole acid is suitably from 13.5 mass % to 18 mass %. The treatment temperature is, for example, suitably in the range of 42° C. to 48° C. The thickness of the coating film is suitably from 0.3 m to 15 μm.

The boehmite treatment, for instance, involves a soak in pure water at a temperature ranging from 90° C. to 100° C. for 5 to 60 minutes or contact with heated steam at a temperature ranging from 90° C. to 120° C. for 5 to 60 minutes. The thickness of the coating film is suitably from 0.1 μm to 5 μm. The coating film is optionally further subjected to an anodic oxidation treatment with an electrolyte solution that less dissolves the coating film, such as adipic acid, boric acid, borate, phosphate, phthalate, maleate, benzoate, tartrate, or citrate.

Undercoat Layer

An example of the undercoat layer is a layer containing inorganic particles and a binder resin.

Examples of the inorganic particles include inorganic particles having a powder resistance (volume resistivity) ranging from $10^2$ Ωcm to $10^{11}$ Ωcm.

Specific examples of the inorganic particles having such a resistance include metal oxide particles such as tin oxide particles, titanium oxide particles, zinc oxide particles, and zirconium oxide particles; in particular, zinc oxide particles are suitable.

The specific surface area of the inorganic particles, which is measured by a BET method, is, for example, suitably 10 $m^2/g$ or more.

The volume average particle size of the inorganic particles is, for instance, suitably from 50 nm to 2000 nm (preferably from 60 nm to 1000 nm).

The amount of the inorganic particles is, for example, preferably from 10 mass % to 80 mass %, and more preferably from 40 mass % to 80 mass % relative the amount of the binder resin.

The inorganic particles are optionally subjected to a surface treatment. Two or more types of inorganic particles subjected to different surface treatments or having different particle sizes may be used in combination.

Examples of a surface treatment agent to be used include a silane coupling agent, a titanate-based coupling agent, an aluminum-based coupling agent, and a surfactant. In particular, a silane coupling agent is preferred, and a silane coupling agent having an amino group is more preferred.

Examples of the silane coupling agent having an amino group include, but are not limited to, 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane.

Two or more silane coupling agents may be used in combination. The silane coupling agent having an amino group may be, for example, used in combination with another silane coupling agent. Examples of such another silane coupling agent include, but are not limited to, vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Any of known surface treatments with surface treatment agents may be employed, and either of a dry process and a wet process may be performed.

The amount of the surface treatment agent to be used is, for instance, suitably from 0.5 mass % to 10 mass % relative to the inorganic particle content.

The undercoat layer may contain an electron-accepting compound (acceptor compound) in addition to the inorganic particles in terms of enhancements in the long-term stability of electrical properties and carrier-blocking properties.

Examples of the electron-accepting compound include electron-transporting materials, for instance, quinone compounds such as chloranil and bromoanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

In particular, the electron-accepting compound is suitably a compound having an anthraquinone structure.

Suitable examples of the compound having an anthraquinone structure include hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer in a state in which it is dispersed along with the inorganic particles or in a state in which it is adhering to the surfaces of the inorganic particles.

The electron-accepting compound is allowed to adhere to the surfaces of the inorganic particles through, for example, a dry process or a wet process.

In a dry process, for instance, the inorganic particles are stirred with a mixer or another equipment having a large shear force, and the electron-accepting compound itself or a solution of the electron-accepting compound in an organic solvent is dropped or sprayed with dry air or nitrogen gas thereto under the stirring, thereby allowing the electron-accepting compound to adhere to the surfaces of the inorganic particles. The dropping or spraying of the electron-accepting compound may be performed at a temperature less than or equal to the boiling point of the solvent. After the dropping or spraying of the electron-accepting compound, the resulting product may be optionally baked at not less than 100° C. The baking may be performed at any temperature for any length of time provided that electrophotographic properties can be produced.

In a wet process, for example, the inorganic particles are dispersed in a solvent by a technique that involves use of stirring, ultrasonic, a sand mill, an attritor, or a ball mill; the electron-accepting compound is added thereto and then stirred or dispersed; and the solvent is subsequently removed, thereby allowing the electron-accepting compound to adhere to the surfaces of the inorganic particles. The solvent is removed, for instance, by filtration or distillation. After the removal of the solvent, the resulting product may be optionally baked at not less than 100° C. The baking may be performed at any temperature for any length of time provided that electrophotographic properties can be produced. In the wet process, the moisture content in the inorganic particles may be removed before the addition of the electron-accepting compound; examples of a technique for the removal include a technique in which the moisture is removed in a solvent under stirring and heating and a technique in which the moisture is removed through azeotropy with a solvent.

The electron-accepting compound may be allowed to adhere to the surfaces of the inorganic particles before or after the inorganic particles are subjected to the surface treatment with a surface treatment agent, and the process for the adhesion of the electron-accepting compound and the surface treatment may be performed at the same time.

The amount of the electron-accepting compound is, for example, suitably from 0.01 mass % to 20 mass %, and preferably from 0.01 mass % to 10 mass % relative to the inorganic particle content.

Examples of the binder resin used for forming the undercoat layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenolic resins, phenol-formaldehyde resins, melamine resins, urethane resins, alkyd resins, and epoxy resins; zirconium chelate compounds; titanium chelate compounds; aluminum chelate compounds; titanium alkoxide compounds; organic titanium compounds; and known materials such as silane coupling agents.

Other examples of the binder resin used for forming the undercoat layer include charge-transporting resins having charge-transporting groups and conductive resins (e.g., polyaniline).

The binder resin used for forming the undercoat layer is suitably insoluble in a solvent used to form the upper layer. In particular, suitable resins are thermosetting resins, such as urea resins, phenolic resins, phenol-formaldehyde resins, melamine resins, urethane resins, unsaturated polyester resins, alkyd resins, and epoxy resins, and resins produced through the reaction of a curing agent with at least one resin selected from the group consisting of polyamide resins, polyester resins, polyether resins, methacrylic resins, acrylic resins, polyvinyl alcohol resins, and polyvinyl acetal resins.

In the case where two or more of these binder resins are used in combination, the mixture ratio is appropriately determined.

The undercoat layer may contain a variety of additives to enhance electrical properties, environmental stability, and image quality.

Examples of the additives include known materials such as electron-transporting pigments (e.g., condensed polycyclic pigments and azo pigments), zirconium chelate compounds, titanium chelate compounds, aluminum chelate compounds, titanium alkoxide compounds, organic titanium compounds, and silane coupling agents. A silane coupling agent is used for the surface treatment of the inorganic particles as described above; however, it may be further added, as an additive, to the undercoat layer.

Examples of the silane coupling agents as the additives include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetra-n-butyl titanate, butyl titanate dimer, tetra(2-ethylhexyl)titanate, titanium acetylacetonate, polytitanium acetylacetonate, titanium octylene glycolate, ammonium salts of titanium lactate, titanium lactate, ethyl esters of titanium lactate, titanium triethanol aminate, and polyhydroxytitanium stearate.

Examples of the aluminum chelate compounds include aluminum isopropylate, monobutoxyaluminum diisopropylate, aluminum butyrate, diethylacetoacetate aluminum diisopropylate, and aluminum tris(ethylacetoacetate).

These additives may be used alone or in the form of a mixture or polycondensate of multiple compounds.

The undercoat layer desirably has a Vickers hardness of not less than 35.

The surface roughness (ten-point average roughness) of the undercoat layer is desirably adjusted to be from 1/(4n) (n is a refractive index of the upper layer) to ½ of the wavelength λ of laser light to be used for exposure in order to reduce Moire fringes.

The undercoat layer may contain, for example, resin particles in order to adjust the surface roughness.

Examples of the resin particles include silicone resin particles and crosslinkable polymethyl methacrylate resin particles. The surface of the undercoat layer may be polished to adjust the surface roughness. Examples of a polishing technique include buff polishing, sandblasting, wet honing, and grinding.

The undercoat layer may be formed by any of known techniques; for instance, the above-mentioned components are added to a solvent to prepare a coating liquid used for forming the undercoat layer, the coating liquid is used to form a coating film, and the coating film is dried and optionally heated.

Examples of the solvent used in the preparation of the coating liquid used for forming the undercoat layer include known organic solvents such as alcohol solvents, aromatic hydrocarbon solvents, halogenated hydrocarbon solvents, ketone solvents, ketone alcohol solvents, ether solvents, and ester solvents.

Specific examples of such solvents include typical organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a technique for dispersing the inorganic particles in the preparation of the coating liquid used for forming the undercoat layer include known techniques that involve use of a roll mill, a ball mill, a vibratory ball mill, an attritor, a sand mill, a colloid mill, or a paint shaker.

Examples of a technique for applying the coating liquid used for forming the undercoat layer onto the conductive substrate include typical techniques such as blade coating, wire bar coating, spray coating, dip coating, bead coating, air knife coating, and curtain coating.

The thickness of the undercoat layer is, for example, preferably 15 μm or more, and more preferably from 18 m to 50 μm.

Intermediate Layer

Although not illustrated, an intermediate layer may be further provided between the undercoat layer and the photosensitive layer.

An example of the intermediate layer is a layer containing resin. Examples of the resin used for forming the intermediate layer include known polymer compounds such as acetal resins (e.g., polyvinyl butyral), polyvinyl alcohol resins, polyvinyl acetal resins, casein resins, polyamide resins, cellulose resins, gelatine, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer containing an organic metal compound. Examples of the organic metal compound used for forming the intermediate layer include organic metal compounds containing metal atoms of zirconium, titanium, aluminum, manganese, or silicon.

These compounds used for forming the intermediate layer may be used alone or in the form of a mixture or polycondensate of multiple compounds.

In particular, the intermediate layer is suitably a layer containing an organic metal compound that contains a zirconium atom or a silicon atom.

The intermediate layer may be formed by any of known techniques; for instance, the above-mentioned components are added to a solvent to prepare a coating liquid used for forming the intermediate layer, the coating liquid is used to form a coating film, and the coating film is dried and optionally heated.

Examples of a technique for applying the coating liquid used for forming the intermediate layer include typical techniques such as dip coating, push-up coating, wire bar coating, spray coating, blade coating, knife coating, and curtain coating.

The thickness of the intermediate layer is suitably adjusted to be, for instance, from 0.1 m to 3 μm. The intermediate layer may serve as the undercoat layer.

Charge-Generating Layer

An example of the charge-generating layer is a layer containing a charge-generating material and a binder resin. The charge-generating layer may be a deposited layer of a charge-generating material. The deposited layer of a charge-generating material is suitable for the case in which an incoherent light source such as a light emitting diode (LED) or an organic electro-luminescence (EL) image array is used.

Examples of the charge-generating material include azo pigments such as bisazo pigments and trisazo pigments; fused ring aromatic pigments such as dibromoanthanthrone; perylene pigments; pyrrolopyrrole pigments; phthalocyanine pigments; zinc oxide; and trigonal selenium.

In particular, suitable charge-generating materials to enable exposure to laser light having a wavelength that is in a near infrared region are metal phthalocyanine pigments and metal-free phthalocyanine pigments. Specific examples of more suitable materials include hydroxygallium phthalocyanines disclosed in Japanese Unexamined Patent Application Publication Nos. 5-263007 and 5-279591, chlorogallium phthalocyanine disclosed in Japanese Unexamined Patent Application Publication No. 5-98181, dichlorotin phthalocyanines disclosed in Japanese Unexamined Patent Application Publication Nos. 5-140472 and 5-140473, and titanyl phthalocyanine disclosed in Japanese Unexamined Patent Application Publication No. 4-189873.

Suitable charge-generating materials to enable exposure to laser light having a wavelength that is in a near ultraviolet region are fused ring aromatic pigments such as dibromoanthanthrone, thioindigo pigments, porphyrazine compounds, zinc oxide, trigonal selenium, and bisazo pigments disclosed in Japanese Unexamined Patent Application Publication Nos. 2004-78147 and 2005-181992.

The above-mentioned charge-generating materials may be used also in the case where an incoherent light source such as an LED or organic EL image array having a central emission wavelength ranging from 450 nm to 780 nm is used; however, when the photosensitive layer has a thickness of not more than 20 m in terms of resolution, the field intensity in the photosensitive layer becomes high, which easily results in a decrease in the degree of charging due to electric charges injected from the substrate, namely the occurrence of image defects called black spots. This phenomenon is more likely to be caused in the case of using charge-generating materials that are p-type semiconductors and that easily generate dark current, such as trigonal selenium and a phthalocyanine pigment.

Use of charge-generating materials that are n-type semiconductors, such as fused ring aromatic pigments, perylene pigments, and azo pigments, is less likely to generate dark current and enables a reduction in the occurrence of image defects called black spots even at the reduced thickness of the photosensitive layer. Examples of such n-type charge-generating materials include, but are not limited to, compounds (CG-1) to (CG-27) disclosed in the paragraphs [0288] to [0291] of Japanese Unexamined Patent Application Publication No. 2012-155282.

In order to distinguish an n-type charge-generating material, a time-of-flight technique that has been generally employed is used to analyze the polarity of flowing photoelectric current, and a material in which electrons are likely to flow as carriers rather than holes is determined as an n-type charge-generating material.

Among these, the charge-generating material is preferably a hydroxygallium phthalocyanine pigment, and more preferably a type-V hydroxygallium phthalocyanine pigment in terms of efficiency in generation of electric charges.

In particular, for instance, a hydroxygallium phthalocyanine pigment having a maximum peak wavelength within the range of 810 nm to 839 nm in an optical absorption spectrum at a wavelength ranging from 600 nm to 900 nm is suitable in terms of excellent dispersibility.

In addition, in the hydroxygallium phthalocyanine pigment having a maximum peak wavelength within the range of 810 nm to 839 nm, it is suitable that the average particle size be within a specific range and that the specific surface area obtained by the BET method be within a specific range. Specifically, the average particle size is preferably 0.20 m or less, and more preferably from 0.01 m to 0.15 μm. The specific surface area obtained by the BET method is preferably 45 $m^2/g$ or more, more preferably 50 $m^2/g$ or more, and especially preferably from 55 $m^2/g$ to 120 $m^2/g$. The average particle size is a volume average particle size (d50 average particle size) measured with a laser diffraction/scattering particle size distribution analyzer (LA-700, manufactured by HORIBA, Ltd.). The specific surface area based on the BET method is measured with a BET specific surface area analyzer (FlowSorb II 2300, manufactured by SHIMADZU CORPORATION) under nitrogen purge.

The maximum particle size (maximum value of primary particle size) of the hydroxygallium phthalocyanine pigment is preferably 1.2 m or less, more preferably 1.0 m or less, and further preferably 0.3 m or less.

The average particle size, maximum particle size, and specific surface are of the hydroxygallium phthalocyanine pigment are suitably 0.2 m or less, 1.2 m or less, and 45 $m^2/g$ or more, respectively.

The hydroxygallium phthalocyanine pigment is suitably a type-V hydroxygallium phthalocyanine pigment having diffraction peaks at Bragg angles (20±0.2°) of at least 7.3°, 16.0°, 24.9°, and 28.0° in an X-ray diffraction spectrum using CuKα characteristic X-rays.

The charge-generating materials may be used alone or in combination.

The binder resin used for forming the charge-generating layer is selected from a variety of insulating resins and may be selected from organic photoconductive polymers such as poly-N-vinylcarbazole, polyvinyl anthracene, polyvinyl pyrene, and polysilane.

Examples of the binder resin include polyvinyl butyral resins, polyarylate resins (such as a polycondensate made from a bisphenol and an aromatic divalent carboxylic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" herein refers to a volume resistivity of not less than $10^{13}$ m.

These binder resins may be used alone or in combination.

The mixture ratio of the charge-generating material to the binder resin is suitably from 10:1 to 1:10 on a weight basis.

The charge-generating layer may further contain a known additive.

The charge-generating layer may be formed by any of known techniques; for instance, the above-mentioned components are added to a solvent to prepare a coating liquid used for forming the charge-generating layer, the coating liquid is used to form a coating film, and the coating film is dried and optionally heated. The charge-generating layer may be formed by depositing the charge-generating material. Such formation of the charge-generating layer by deposition is suitable particularly in the case of using a fused ring aromatic pigment or a perylene pigment as the charge-generating material.

Examples of the solvent used in the preparation of the coating liquid used for forming the charge-generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents may be used alone or in combination.

Particles (e.g., charge-generating material) are, for example, dispersed in the coating liquid used for forming the charge-generating layer with a disperser involving use of media, such as a ball mill, a vibratory ball mill, an attritor, a sand mill, or horizontal sand mill, or with a media-free disperser such as a stirrer, an ultrasonic disperser, a roll mill, and a high-pressure homogenizer. Examples of the high-pressure homogenizer include an impact-type homogenizer in which a highly pressurized dispersion liquid is allowed to collide with another liquid or a wall for dispersion and a through-type homogenizer in which a highly pressurized dispersion liquid is allowed to flow through a fine flow channel for dispersion.

In this dispersion procedure, it is effective that the average particle size of the charge-generating material used in the coating liquid for forming the charge-generating layer is not more than 0.5 μm, preferably not more than 0.3 μm, and more preferably not more than 0.15 μm.

Examples of a technique for applying the coating liquid used for forming the charge-generating layer onto the undercoat layer (or intermediate layer) include typical techniques such as blade coating, wire bar coating, spray coating, dip coating, bead coating, air knife coating, and curtain coating.

The thickness of the charge-generating layer is, for example, adjusted to be preferably from 0.1 μm to 5.0 μm, and more preferably from 0.2 μm to 2.0 μm.

Charge-Transporting Layer

The charge-transporting layer is, for instance, a layer containing a charge-transporting material and a binder resin. The charge-transporting layer contains the crystals of the charge-transporting material.

Charge-Transporting Material

The average particle size of the crystals of the charge-transporting material is approximately from 0.1 μm to 5.0 μm. The crystals of the charge-transporting material having an average particle size of 0.1 μm or more enable reductions in the wear of the charge-transporting layer as the outermost layer and in the occurrence of cracks. The crystals of the charge-transporting material having an average particle size of 5.0 μm or less contribute to a reduction in the degradation of electrical properties.

The average particle size of the crystals of the charge-transporting material is preferably from 1.0 m to 4.0 μm, and more preferably from 1.2 m to 3.8 μm in terms of reductions in the wear of the charge-transporting layer as the outermost layer and in the occurrence of cracks.

The average particle size of the crystals of the charge-transporting material can be adjusted to be in the above-mentioned range, for example, by (1) using a charge-transporting material that can be easily crystallized or (2) using a poor solvent for the charge-transporting material as the solvent of a coating liquid for forming the charge-transporting layer.

The average particle size of the crystals of the charge-transporting material is measured as follows.

A measurement sample is taken from the charge-transporting layer of a photoreceptor that is to be analyzed. The measurement sample is taken so as to have a cross section in the direction of the thickness of the charge-transporting layer.

The measurement sample is observed with a laser microscope at a magnification of 100 and a visual field of 1 mm×1 mm.

In an image obtained by the observation, the largest diameters of 10 crystals of the charge-transporting material are individually determined. Then, the average of the largest diameters of the crystals of the charge-transporting material is defined as the average particle size.

Examples of the charge-transporting material include electron-transporting compounds, e.g., quinone compounds such as p-benzoquinone, chloranil, bromanil, and anthraquinone; tetracyanoquinodimethane compounds; fluorenone compounds such as 2,4,7-trinitrofluorenone; xanthone compounds; benzophenone compounds; cyanovinyl compounds; and ethylene compounds. Other examples of the charge-transporting material include hole-transporting compounds such as triarylamine compounds, benzidine compounds, arylalkane compounds, aryl-substituted ethylene compounds, stilbene compounds, anthracene compounds, and hydrazone compounds. These charge-transporting materials are used alone or in combination but not limited thereto.

Among these, benzidine charge-transporting materials are suitable because they easily enable the crystals of the charge-transporting material to have an average particle size in the above-mentioned range.

The benzidine charge-transporting material is a charge-transporting material having a benzidine structure "N-Ph-Ph-N (where Ph is a phenyl group)".

The benzidine charge-transporting material is suitably any of charge-transporting materials represented by General Formula (CT1).

(CT1)

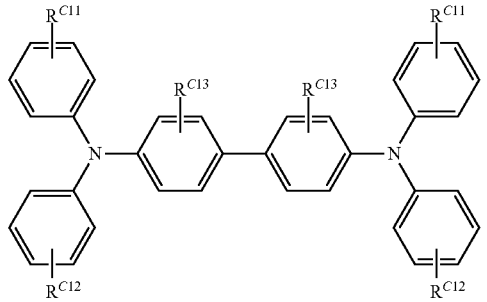

In General Formula (CT1), $R^{C11}$, $R^{C12}$, and $R^{C13}$ each independently represent a hydrogen atom, a halogen atom, an alkyl group having from 1 to 10 carbon atoms, an alkoxy group having from 1 to 10 carbon atoms, or an aryl group having from 6 to 10 carbon atoms.

In General Formula (CT1), examples of the halogen atom that $R^{C11}$, $R^{C12}$, and $R^{C13}$ represent include a fluorine atom, a chlorine atom, a bromine atom, and an iodine atom. Among these, the halogen atom is preferably a fluorine atom or a chlorine atom, and more preferably a chlorine atom.

In General Formula (CT1), examples of the alkyl group that $R^{C11}$, $R^{C12}$, and $R^{C13}$ represent include linear or branched alkyl groups each having from 1 to 10 carbon atoms (preferably from 1 to 6 carbon atoms, and more preferably from 1 to 4 carbon atoms).

Specific examples of the linear alkyl group include a methyl group, an ethyl group, an n-propyl group, an n-butyl group, an n-pentyl group, an n-hexyl group, an n-heptyl group, an n-octyl group, an n-nonyl group, and an n-decyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, and a tert-decyl group.

Among these, lower alkyl groups, such as a methyl group, an ethyl group, and an isopropyl group, are suitable as the alkyl group.

In General Formula (CT1), examples of the alkoxy group that $R^{C11}$, $R^{C12}$, and $R^{C13}$ represent include linear or branched alkoxy groups each having from 1 to 10 carbon atoms (preferably from 1 to 6 carbon atoms, and more preferably from 1 to 4 carbon atoms).

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, and an n-decyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, and a tert-decyloxy group.

Among these, a methoxy group is suitable as the alkoxy group.

In General Formula (CT1), examples of the aryl group that $R^{C11}$, $R^{C12}$, and $R^{C13}$ represent include aryl groups each having from 6 to 10 carbon atoms (preferably from 6 to 9 carbon atoms, and more preferably from 6 to 8 carbon atoms).

Specific examples of the aryl group include a phenyl group and a naphthyl group.

Among these, a phenyl group is suitable as the aryl group.

In General Formula (CT1), the substituents that $R^{C11}$, $R^{C12}$, and $R^{C13}$ represent also include groups each further having a substituent. Examples of such a substituent include the atoms and groups described above as examples (such as a halogen atom, an alkyl group, an alkoxy group, and an aryl group).

In order to form a photosensitive layer (charge-transporting layer) having a high capability of transporting charges, it is preferred that $R^{C11}$, $R^{C12}$, and $R^{C13}$ in General Formula (CT1) each independently represent a hydrogen atom or an alkyl group having from 1 to 10 carbon atoms, and it is more preferred that $R^{C11}$ and $R^{C13}$ each represent a hydrogen atom and that $R^{C12}$ represent an alkyl group having from 1 to 10 carbon atoms (particularly, methyl group).

In particular, the benzidine charge-transporting material represented by General Formula (CT1) is suitably a charge-transporting material represented by Structural Formula (CT1A) [example compound (CT1-2)].

(CT1A)

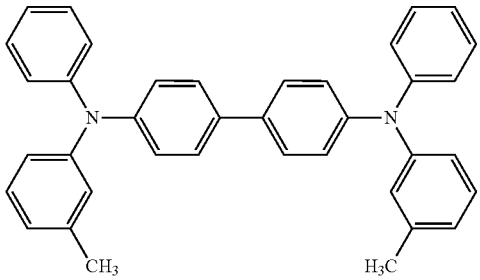

Specific examples of the benzidine charge-transporting material will now be given, but the benzidine charge-transporting material is not limited thereto.

| Example compound No. | $R^{C11}$ | $R^{C12}$ | $R^{C13}$ |
|---|---|---|---|
| CT1- 1 | H | H | H |
| CT1- 2 | H | 3-$CH_3$ | H |
| CT1- 3 | H | 4-$CH_3$ | H |
| CT1- 4 | H | 3-$C_2H_5$ | H |
| CT1- 5 | H | 4-$C_2H_5$ | H |
| CT1- 6 | H | 3-$OCH_3$ | H |
| CT1- 7 | H | 4-$OCH_3$ | H |
| CT1- 8 | H | 3-$OC_2H_5$ | H |
| CT1- 9 | H | 4-$OC_2H_5$ | H |
| CT1-10 | 3-$CH_3$ | 3-$CH_3$ | H |
| CT1-11 | 4-$CH_3$ | 4-$CH_3$ | H |
| CT1-12 | 3-$C_2H_5$ | 3-$C_2H_5$ | H |
| CT1-13 | 4-$C_2H_5$ | 4-$C_2H_5$ | H |
| CT1-14 | H | H | 2-$CH_3$ |
| CT1-15 | H | H | 3-$CH_3$ |
| CT1-16 | H | 3-$CH_3$ | 2-$CH_3$ |
| CT1-17 | H | 3-$CH_3$ | 3-$CH_3$ |
| CT1-18 | H | 4-$CH_3$ | 2-$CH_3$ |
| CT1-19 | H | 4-$CH_3$ | 3-$CH_3$ |
| CT1-20 | 3-$CH_3$ | 3-$CH_3$ | 2-$CH_3$ |
| CT1-21 | 3-$CH_3$ | 3-$CH_3$ | 3-$CH_3$ |
| CT1-22 | 4-$CH_3$ | 4-$CH_3$ | 2-$CH_3$ |
| CT1-23 | 4-$CH_3$ | 4-$CH_3$ | 3-$CH_3$ |

In the above example compounds, the abbreviations have the following meanings. The numbers given before the substituents are each a site of substitution on the benzene ring.

$CH_3$: methyl group $C_2H_5$: ethyl group $OCH_3$: methoxy group $OC_2H_5$: ethoxy group The proportion of the benzidine charge-transporting material in the charge-transporting materials is preferably from 90 mass % to 100 mass %, and more preferably from 98 mass % to 100 mass %.

The charge-transporting material may be a combination of the benzidine charge-transporting material with a triarylamine charge-transporting material in order to enhance electrical properties.

The triarylamine charge-transporting material is a charge-transporting material having a triarylamine structure. The triarylamine charge-transporting material is a charge-transporting material represented by General Formula (CT2).

(CT2)

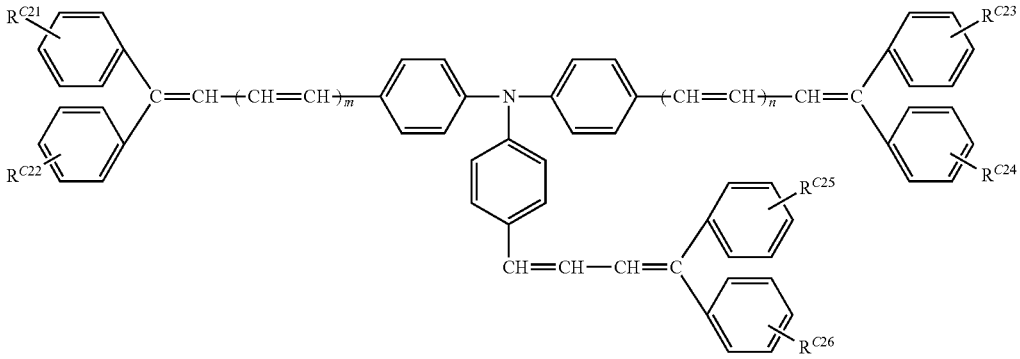

In General Formula (CT2), $R^{C21}$, $R^{C22}$, $R^{C23}$, $R^{C24}$, $R^{25}$, and $R^{C26}$ each independently represent a hydrogen atom, a halogen atom, an alkyl group having from 1 to 20 carbon atoms, an alkoxy group having from 1 to 20 carbon atoms, or an aryl group having from 6 to 30 carbon atoms; and the adjoining two of these substituents may be bonded to each other into a hydrocarbon ring structure.

n and m each independently represent 0, 1, or 2.

In General Formula (CT2), examples of the halogen atom that $R^{C21}$, $R^{C22}$, $R^{C23}$, $R^{C24}$, $R^{C25}$, and $R^{C26}$ represent include a fluorine atom, a chlorine atom, a bromine atom, and an iodine atom. Among these, the halogen atom is preferably a fluorine atom or a chlorine atom, and more preferably a chlorine atom.

In General Formula (CT2), examples of the alkyl group that $R^{C21}$, $R^{C22}$, $R^{C23}$, $R^{C24}$, $R^{C25}$, and $R^{C26}$ represent include linear or branched alkyl groups each having from 1 to 20 carbon atoms (preferably from 1 to 6 carbon atoms, and more preferably from 1 to 4 carbon atoms).

Specific examples of the linear alkyl group include a methyl group, an ethyl group, an n-propyl group, an n-butyl group, an n-pentyl group, an n-hexyl group, an n-heptyl group, an n-octyl group, an n-nonyl group, an n-decyl group, an n-undecyl group, an n-dodecyl group, an n-tridecyl group, an n-tetradecyl group, an n-pentadecyl group, an n-hexadecyl group, an n-heptadecyl group, an n-octadecyl group, an n-nonadecyl group, and an n-icosyl group.

Specific examples of the branched alkyl group include an isopropyl group, an isobutyl group, a sec-butyl group, a tert-butyl group, an isopentyl group, a neopentyl group, a tert-pentyl group, an isohexyl group, a sec-hexyl group, a tert-hexyl group, an isoheptyl group, a sec-heptyl group, a tert-heptyl group, an isooctyl group, a sec-octyl group, a tert-octyl group, an isononyl group, a sec-nonyl group, a tert-nonyl group, an isodecyl group, a sec-decyl group, a tert-decyl group, an isoundecyl group, a sec-undecyl group, a tert-undecyl group, a neoundecyl group, an isododecyl group, a sec-dodecyl group, a tert-dodecyl group, a neododecyl group, an isotridecyl group, a sec-tridecyl group, a tert-tridecyl group, a neotridecyl group, an isotetradecyl group, a sec-tetradecyl group, a tert-tetradecyl group, a neotetradecyl group, a 1-isobutyl-4-ethyloctyl group, an isopentadecyl group, a sec-pentadecyl group, a tert-pentadecyl group, a neopentadecyl group, an isohexadecyl group, a sec-hexadecyl group, a tert-hexadecyl group, a neohexadecyl group, a 1-methylpentadecyl group, an isoheptadecyl group, a sec-heptadecyl group, a tert-heptadecyl group, a neoheptadecyl group, an isooctadecyl group, a sec-octadecyl group, a tert-octadecyl group, a neooctadecyl group, an isononadecyl group, a sec-nonadecyl group, a tert-nonadecyl group, a neononadecyl group, a 1-methyloctyl group, an isoicosyl group, a sec-icosyl group, a tert-icosyl group, and a neoicosyl group.

Among these, lower alkyl groups, such as a methyl group, an ethyl group, and an isopropyl group, are suitable as the alkyl group.

In General Formula (CT2), examples of the alkoxy group that $R^{C21}$, $R^{C22}$, $R^{C23}$, $R^{C24}$, $R^{C25}$, and $R^{C26}$ represent include linear or branched alkoxy groups each having from 1 to 20 carbon atoms (preferably from 1 to 6 carbon atoms, and more preferably from 1 to 4 carbon atoms).

Specific examples of the linear alkoxy group include a methoxy group, an ethoxy group, an n-propoxy group, an n-butoxy group, an n-pentyloxy group, an n-hexyloxy group, an n-heptyloxy group, an n-octyloxy group, an n-nonyloxy group, an n-decyloxy group, an n-undecyloxy group, an n-dodecyloxy group, an n-tridecyloxy group, an n-tetradecyloxy group, an n-pentadecyloxy group, an n-hexadecyloxy group, an n-heptadecyloxy group, an n-octadecyloxy group, an n-nonadecyloxy group, and an n-icosyloxy group.

Specific examples of the branched alkoxy group include an isopropoxy group, an isobutoxy group, a sec-butoxy group, a tert-butoxy group, an isopentyloxy group, a neopentyloxy group, a tert-pentyloxy group, an isohexyloxy group, a sec-hexyloxy group, a tert-hexyloxy group, an isoheptyloxy group, a sec-heptyloxy group, a tert-heptyloxy group, an isooctyloxy group, a sec-octyloxy group, a tert-octyloxy group, an isononyloxy group, a sec-nonyloxy group, a tert-nonyloxy group, an isodecyloxy group, a sec-decyloxy group, a tert-decyloxy group, an isoundecyloxy group, a sec-undecyloxy group, a tert-undecyloxy group, a neoundecyloxy group, an isododecyloxy group, a sec-dodecyloxy group, a tert-dodecyloxy group, a neododecyloxy group, an isotridecyloxy group, a sec-tridecyloxy group, a tert-tridecyloxy group, a neotridecyloxy group, an isotetradecyloxy group, a sec-tetradecyloxy group, a tert-tetradecyloxy group, a neotetradecyloxy group, a 1-isobutyl-4-ethyloctyloxy group, an isopentadecyloxy group, a sec-pentadecyloxy group, a tert-pentadecyloxy group, a neopentadecyloxy group, an isohexadecyloxy group, a sec-hexadecyloxy group, a tert-hexadecyloxy group, a neohexadecyloxy group, a 1-methylpentadecyloxy group, an isoheptadecyloxy group, a sec-heptadecyloxy group, a tert-heptadecyloxy group, a neoheptadecyloxy group, an isooctadecyloxy group, a sec-octadecyloxy group, a tert-octadecyloxy group, a neooctadecyloxy group, an isononadecyloxy group, a sec-nonadecyloxy group, a tert-nonadecyloxy group, a neononadecyloxy group, a 1-methyloctyloxy group, an isoicosyloxy group, a sec-icosyloxy group, a tert-icosyloxy group, and a neoicosyloxy group.

Among these, a methoxy group is suitable as the alkoxy group.

In General Formula (CT2), examples of the aryl group that $R^{C21}$, $R^{C22}$, $R^{C23}$, $R^{C24}$, $R^{C25}$, and $R^{C26}$ represent include aryl groups each having from 6 to 30 carbon atoms (preferably from 6 to 20 carbon atoms, and more preferably from 6 to 16 carbon atoms).

Specific examples of the aryl group include a phenyl group, a naphthyl group, a phenanthryl group, and a biphenylyl group.

Among these, a phenyl group and a naphthyl group are suitable as the aryl group.

In General Formula (CT2), the substituents that $R^{C21}$, $R^{C22}$, $R^{C23}$, $R^{C24}$, $R^{C25}$, and $R^{C26}$ represent also include groups each further having a substituent. Examples of such a substituent include the atoms and groups described above as examples (such as a halogen atom, an alkyl group, an alkoxy group, and an aryl group).

In a hydrocarbon ring structure in which two adjoining substituents out of $R^{C21}$, $R^{C22}$, $R^{C23}$, $R^{C24}$, $R^{C25}$, and $R^{C26}$ in General Formula (CT2) (for example, $R^{C21}$ and $R^{C22}$, $R^{C23}$ and $R^{C24}$ or $R^{C25}$ and $R^{C26}$) are bonded to each other, the substituents are bonded to each other via, for instance, a single bond, a 2,2'-methylene group, a 2,2'-ethylene group, or a 2,2'-vinylene group; among these, a single bond and a 2,2'-methylene group are suitable.

Specific examples of the hydrocarbon ring structure include a cycloalkane structure, a cycloalkene structure, and a cycloalkane polyene structure.

In General Formula (CT2), n and m are each suitably 1.

In order to form a photosensitive layer (charge-transporting layer) having a high capability of transporting charges, it is preferred that $R^{C21}$, $R^{C22}$, $R^{C23}$, $R^{C24}$, $R^{C25}$, and $R^{C26}$ in General Formula (CT2) each represent a hydrogen atom, an alkyl group having from 1 to 20 carbon atoms, or an alkoxy group having from 1 to 20 carbon atoms and that m and n each represent 1 or 2; and it is more preferred that $R^{C21}$, $R^{C22}$, $R^{C23}$, $R^{C24}$, $R^{C25}$, and $R^{C26}$ each represent a hydrogen atom and that m and n each represent 1.

In particular, the triarylamine charge-transporting material is suitably a charge-transporting material represented by Structural Formula (CT2A) [example compound (CT2-3)].

(CT2A)

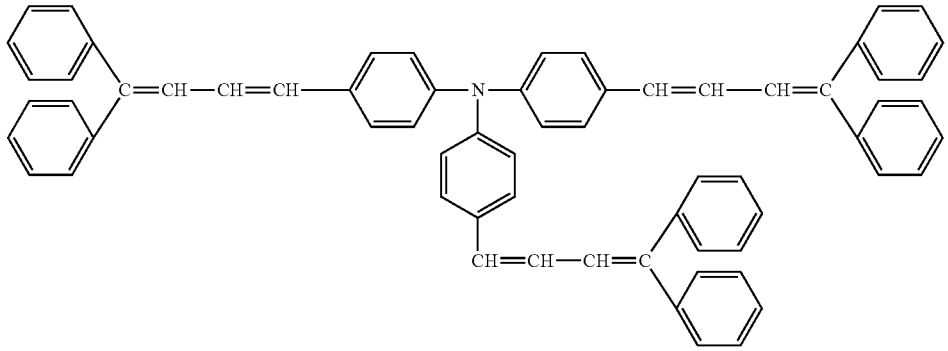

Specific examples of the triarylamine charge-transporting material represented by General Formula (CT2) will now be given, but the triarylamine charge-transporting material represented by General Formula (CT2) is not limited thereto.

| Example compound No. | m | n | $R^{C21}$ | $R^{C22}$ | $R^{C23}$ | $R^{C24}$ | $R^{C25}$ | $R^{C26}$ |
|---|---|---|---|---|---|---|---|---|
| CT2-1 | 1 | 1 | 4-$CH_3$ | 4-$CH_3$ | 4-$CH_3$ | 4-$CH_3$ | H | H |
| CT2-2 | 2 | 2 | H | H | H | H | 4-$CH_3$ | 4-$CH_3$ |
| CT2-3 | 1 | 1 | H | H | H | H | H | H |
| CT2-4 | 2 | 2 | H | H | H | H | H | H |
| CT2-5 | 1 | 1 | 4-$CH_3$ | 4-$CH_3$ | 4-$CH_3$ | H | H | H |
| CT2-6 | 0 | 1 | H | H | H | H | H | H |
| CT2-7 | 0 | 1 | 4-$CH_3$ | 4-$CH_3$ | 4-$CH_3$ | 4-$CH_3$ | 4-$CH_3$ | 4-$CH_3$ |
| CT2-8 | 0 | 1 | 4-$CH_3$ | 4-$CH_3$ | H | H | 4-$CH_3$ | 4-$CH_3$ |
| CT2-9 | 0 | 1 | H | H | 4-$CH_3$ | 4-$CH_3$ | H | H |
| CT2-10 | 0 | 1 | H | H | 4-$CH_3$ | 4-$CH_3$ | H | H |
| CT2-11 | 0 | 1 | 4-$CH_3$ | H | H | H | 4-$CH_3$ | H |
| CT2-12 | 0 | 1 | 4-$OCH_3$ | H | H | H | 4-$OCH_3$ | H |
| CT2-13 | 0 | 1 | H | H | 4-$OCH_3$ | 4-$OCH_3$ | H | H |
| CT2-14 | 0 | 1 | 4-$OCH_3$ | H | 4-$OCH_3$ | H | 4-$OCH_3$ | 4-$OCH_3$ |
| CT2-15 | 0 | 1 | 3-$CH_3$ | H | 3-$CH_3$ | H | 3-$CH_3$ | H |
| CT2-16 | 1 | 1 | 4-$CH_3$ | 4-$CH_3$ | 4-$CH_3$ | 4-$CH_3$ | 4-$CH_3$ | 4-$CH_3$ |
| CT2-17 | 1 | 1 | 4-$CH_3$ | 4-$CH_3$ | H | H | 4-$CH_3$ | 4-$CH_3$ |
| CT2-18 | 1 | 1 | H | H | 4-$CH_3$ | 4-$CH_3$ | H | H |
| CT2-19 | 1 | 1 | H | H | 3-$CH_3$ | 3-$CH_3$ | H | H |
| CT2-20 | 1 | 1 | 4-$CH_3$ | H | H | H | 4-$CH_3$ | H |
| CT2-21 | 1 | 1 | 4-$OCH_3$ | H | H | H | 4-$OCH_3$ | H |

-continued

| Example compound No. | m | n | $R^{C21}$ | $R^{C22}$ | $R^{C23}$ | $R^{C24}$ | $R^{C25}$ | $R^{C26}$ |
|---|---|---|---|---|---|---|---|---|
| CT2-22 | 1 | 1 | H | H | 4-$OCH_3$ | 4-$OCH_3$ | H | H |
| CT2-23 | 1 | 1 | 4-$OCH_3$ | H | 4-$OCH_3$ | H | 4-$OCH_3$ | 4-$OCH_3$ |
| CT2-24 | 1 | 1 | 3-$CH_3$ | H | 3-$CH_3$ | H | 3-$CH_3$ | H |

In the above example compounds, the abbreviations have the following meanings. The numbers given before the substituents are each a site of substitution on the benzene ring.

$CH_3$: methyl group $OCH_3$: methoxy group

The proportion of the triarylamine charge-transporting material in the charge-transporting materials is preferably from 0 mass % to 10 mass %, and more preferably from 0 mass % to 2 mass %.

The mass ratio of the charge-transporting material to the binder resin in the charge-transporting layer is, for example, suitably in the range of 2:8 to 8:2.

The amount of the charge-transporting material is, for instance, preferably in the range of 20 mass % to 80 mass %, and more preferably 40 mass % to 60 mass % relative to the whole charge-transporting layer.

Binder Resin

Examples of the binder resin used in the charge-transporting layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenol-formaldehyde resins, styrene-alkyd resins, poly-N-vinylcarbazole, and polysilane. Among these, polycarbonate resins and polyarylate resins are suitable as the binder resin. These binder resins are used alone or in combination.

In particular, polycarbonate resins are more suitable in terms of reductions in the wear of the charge-transporting layer as the outermost layer and in the occurrence of cracks.

Such binder resins originally have a small wear resistance but are flexible. Even when the binder resins are used, the wear of the charge-transporting layer as the outermost layer is likely to be reduced because of the presence of the crystals of the charge-transporting material having the above-mentioned average particle size in the charge-transporting layer. In addition, the occurrence of cracks in the charge-transporting layer is also likely to be reduced owing to the flexibility of the binder resins.

Poor Solvent

The charge-transporting layer suitably contains a residual solvent that is a poor solvent for the charge-transporting material. In other words, a poor solvent is suitably used as the solvent of a coating liquid for forming the charge-transporting layer in terms of reductions in the wear of the charge-transporting layer as the outermost layer and in the occurrence of cracks.

The poor solvent for the charge-transporting material refers to a solvent to which the charge-transporting material exhibits a low solubility. Specifically, when 30 parts by mass (30 mass %) or less of the charge-transporting material can be dissolved in 100 parts by mass of a solvent at 25° C., such a solvent is the poor solvent.

In contrast, a good solvent for the charge-transporting material refers to a solvent to which the charge-transporting material exhibits a high solubility.

Specifically, when more than 30 parts by mass (30 mass %) of the charge-transporting material can be dissolved in 100 parts by mass of a solvent at 25° C., such a solvent is the good solvent.

The solubility of the charge-transporting material is determined as follows. In the case of a good solvent, 1 mg of the charge-transporting material is repeatedly added to 1 g of the solvent. In the case of a poor solvent, 1 mg of the charge-transporting material is repeatedly added to 100 g of the solvent. The solution is adjusted to be 25° C. and stirred, and the dissolution of the charge-transporting material is observed (namely, the solution is observed to see if the charge-transporting material is visually recognized). The total amount of the charge-transporting material added until generation of an undissolved material (visually recognizable charge-transporting material) is defined as the solubility.

Examples of the poor solvent include dialkylketone and carboxylate esters.

Of these, dialkylketone is suitable. In particular, the poor solvent for the benzidine charge-transporting material is suitably dialkylketone.

Examples of dialkylketone include dialkylketone of which the two alkyl groups each have from 1 to 10 carbon atoms (alternatively, from 1 to 6 carbon atoms). Specific examples of such dialkylketone include acetone, methyl ethyl ketone, methyl isobutyl ketone, methyl amyl ketone, methyl isoamyl ketone, and methyl propyl ketone.

The amount of the poor solvent is preferably from 100 ppm to 5000 ppm, and more preferably from 2000 ppm to 5000 ppm relative to the charge-transporting layer in terms of reductions in the wear of the charge-transporting layer as the outermost layer and in the occurrence of cracks. In this case, ppm is on a mass basis.

Other Additives

The charge-transporting layer may further contain a known additive.

Formation of Charge-Transporting Layer

The charge-transporting layer may be formed by any of known techniques; for instance, the above-mentioned components are added to a solvent to prepare a coating liquid used for forming the charge-transporting layer, the coating liquid is used to form a coating film, and the coating film is dried and optionally heated.

Examples of the solvent used in the preparation of the coating liquid used for forming the charge-transporting layer include typical organic solvents, e.g., aromatic hydrocarbons such as benzene, toluene, xylene, and chlorobenzene; ketones such as acetone and 2-butanone; halogenated aliphatic hydrocarbons such as methylene chloride, chloroform, and ethylene chloride; and cyclic or straight-chain ethers such as tetrahydrofuran and ethyl ether. These solvents are used alone or in combination.

Such good solvents for the charge-transporting material are suitably used in combination with a poor solvent for the charge-transporting material in terms of reductions in the wear of the charge-transporting layer as the outermost layer and in the occurrence of cracks. A mass ratio of the good solvent to the poor solvent (good solvent/poor solvent) is preferably from 0/10 to 3/7, and more preferably from 1/9 to 2/8.

Examples of a technique for applying the coating liquid used for forming the charge-transporting layer onto the charge-generating layer include typical techniques such as blade coating, wire bar coating, spray coating, dip coating, bead coating, air knife coating, and curtain coating.

The thickness of the charge-transporting layer is, for instance, adjusted to be preferably from 5 μm to 50 μm, and more preferably from 10 m to 30 μm.

Single-layer Photosensitive Layer

The single-layer photosensitive layer (charge-generating/charge-transporting layer) is, for example, a layer containing a charge-generating material, a charge-transporting material, and optionally a binder resin and another known additive. These materials are the same as those described as the materials used for forming the charge-generating layer and the charge-transporting layer.

The amount of the charge-generating material contained in the single-layer photosensitive layer is suitably from 0.1 mass % to 10 mass %, and preferably from 0.8 mass % to 5 mass % relative to the total solid content.

The amounts of the charge-transporting material, poor solvent, and another material contained in the single-layer photosensitive layer are the same as those in the charge-transporting layer.

The single-layer photosensitive layer is formed by the same technique as those for forming the charge-generating layer and the charge-transporting layer.

The thickness of the single-layer photosensitive layer is, for instance, suitably from 5 m to 50 μm, and preferably from 10 m to 40 μm.

Image Forming Apparatus (and Process Cartridge)

An image forming apparatus according to a second exemplary embodiment includes an electrophotographic photoreceptor, a charging unit that charges the surface of the electrophotographic photoreceptor, an electrostatic latent image forming unit that forms an electrostatic latent image on the charged surface of the electrophotographic photoreceptor, a developing unit that develops the electrostatic latent image on the surface of the electrophotographic photoreceptor with a developer containing toner to form a toner image, and a transfer unit that transfers the toner image to the surface of a recording medium. The electrophotographic photoreceptor is the electrophotographic photoreceptor according to the first exemplary embodiment.

The image forming apparatus according to the second exemplary embodiment may be any of the following known image forming apparatuses: an apparatus which has a fixing unit that fixes the toner image transferred to the surface of a recording medium, a direct-transfer-type apparatus in which the toner image formed on the surface of the electrophotographic photoreceptor is directly transferred to a recording medium, an intermediate-transfer-type apparatus in which the toner image formed on the surface of the electrophotographic photoreceptor is subjected to first transfer to the surface of an intermediate transfer body and in which the toner image transferred to the surface of the intermediate transfer body is then subjected to second transfer to the surface of a recording medium, an apparatus which has a cleaning unit that cleans the surface of the electrophotographic photoreceptor after the transfer of a toner image and before the charging of the electrophotographic photoreceptor, an apparatus which has a charge-neutralizing unit that radiates light to the surface of an image holding member for removal of charges after the transfer of a toner image and before the charging of the image holding member, and an apparatus which has an electrophotographic photoreceptor heating member that heats the electrophotographic photoreceptor to decrease the relative temperature.

In the intermediate-transfer-type apparatus, the transfer unit, for example, includes an intermediate transfer body of which a toner image is to be transferred to the surface, a first transfer unit which serves for first transfer of the toner image formed on the surface of an image holding member to the surface of the intermediate transfer body, and a second transfer unit which serves for second transfer of the toner image transferred to the surface of the intermediate transfer body to the surface of a recording medium.

The image forming apparatus according to the second exemplary embodiment may be either of a dry development type and a wet development type (development with a liquid developer is performed).

In the structure of the image forming apparatus according to the second exemplary embodiment, for instance, the part that includes the electrophotographic photoreceptor may be in the form of a cartridge that is removably attached to the image forming apparatus (process cartridge). A suitable example of the process cartridge to be used is a process cartridge including the electrophotographic photoreceptor according to the first exemplary embodiment.

The process cartridge may include, in addition to the electrophotographic photoreceptor, at least one selected from the group consisting of, for example, the charging unit, the electrostatic latent image forming unit, the developing unit, and the transfer unit.

An example of the image forming apparatus according to the second exemplary embodiment will now be described; however, the image forming apparatus according to the second exemplary embodiment is not limited thereto. The parts shown in the drawing are described, while description of the other parts is omitted.

Figure 2:
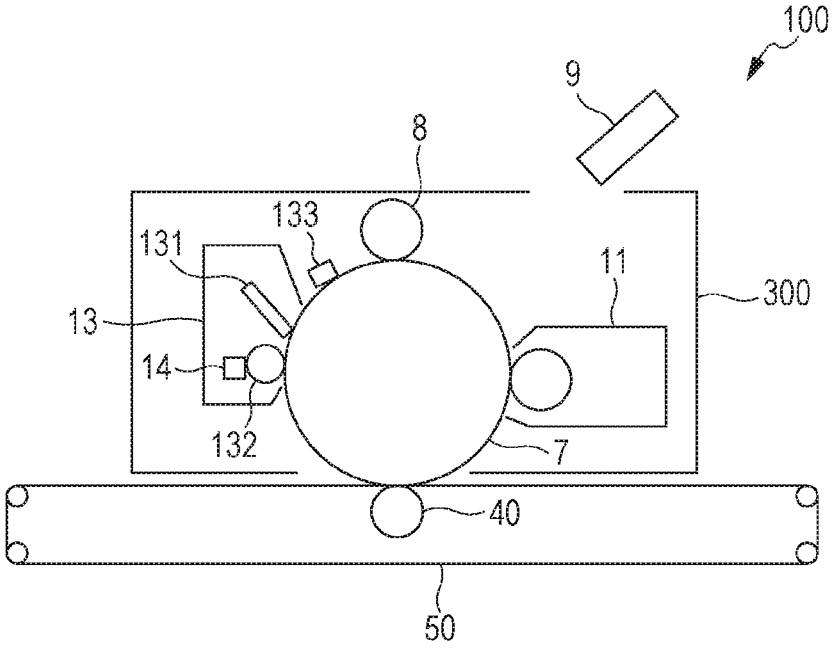
FIG. 2 schematically illustrates an example of the structure of an image forming apparatus according to a second exemplary embodiment.

FIG. 2 schematically illustrates an example of the structure of the image forming apparatus according to the second exemplary embodiment.

As illustrated in FIG. 2, an image forming apparatus 100 according to the second exemplary embodiment includes a process cartridge 300 having an electrophotographic photoreceptor 7, an exposure device 9 (example of the electrostatic latent image forming unit), a transfer device 40 (first transfer device), and an intermediate transfer body 50. In the image forming apparatus 100, the exposure device 9 is disposed such that the electrophotographic photoreceptor 7 can be irradiated with light through the opening of the process cartridge 300, the transfer device 40 is disposed so as to face the electrophotographic photoreceptor 7 with the intermediate body 50 interposed therebetween, and the intermediate body 50 is placed such that part thereof is in contact with the electrophotographic photoreceptor 7. Although not illustrated, the image forming apparatus also includes a second transfer device that transfers a toner image transferred to the intermediate transfer body 50 to a recording medium (e.g., paper). In this case, the intermediate transfer body 50, the transfer device 40 (first transfer device), and the second transfer device (not illustrated) are an example of the transfer unit.

In the process cartridge 300 illustrated in FIG. 2, a housing integrally accommodates the electrophotographic photoreceptor 7, the charging device 8 (example of the charging unit), the developing device 11 (example of the developing unit), and the cleaning device 13 (example of the cleaning unit). The cleaning device 13 has a cleaning blade 131 (example of a cleaning member), and the cleaning blade 131 is disposed so as to be in contact with the surface of the electrophotographic photoreceptor 7. The cleaning member does not need to be in the form of the cleaning blade 131 but may be a conductive or insulating fibrous member; this fibrous member may be used alone or in combination with the cleaning blade 131.

The example of the image forming apparatus in FIG. 2 includes a fibrous member 132 (roll) that supplies a lubricant 14 to the surface of the electrophotographic photoreceptor 7 and a fibrous member 133 (flat brush) that supports the cleaning, and these members are optionally placed.

Each part of the image forming apparatus according to the second exemplary embodiment will now be described.

Charging Device

Examples of the charging device 8 include contact-type chargers that involve use of a conductive or semi-conductive charging roller, charging brush, charging film, charging rubber blade, or charging tube. Any of other known chargers may be used, such as a non-contact-type roller charger and a scorotron or coroton charger in which corona discharge is utilized.

Exposure Device

Examples of the exposure device 9 include optical systems that expose the surface of the electrophotographic photoreceptor 7 to light, such as light emitted from a semiconductor laser, an LED, or a liquid crystal shutter, in the shape of the intended image. The wavelength of light source is within the spectral sensitivity of the electrophotographic photoreceptor. The light from a semiconductor laser is generally near-infrared light having an oscillation wavelength near 780 nm. The wavelength of the light is, however, not limited thereto; laser light having an oscillation wavelength of the order of 600 nm or blue laser light having an oscillation wavelength ranging from 400 nm to 450 nm may be employed. A surface-emitting laser source that can emit multiple beams is also effective for formation of color images.

Developing Device

Examples of the developing device 11 include general developing devices that develop images through contact or non-contact with a developer. The developing device 11 is not particularly limited provided that it has the above-mentioned function, and a proper structure for the intended use is selected. An example of the developing device 11 is a known developing device that functions to attach a one-component or two-component developer to the electrophotographic photoreceptor 7 with a brush or a roller. In particular, a developing device including a developing roller of which the surface holds a developer is suitable.

The developer used in the developing device 11 may be either of a one-component developer of toner alone and a two-component developer containing toner and a carrier. The developer may be either magnetic or non-magnetic. Any of known developers may be used.

Cleaning Device

The cleaning device 13 is a cleaning-blade type in which the cleaning blade 131 is used.

The cleaning device 13 may have a structure other than the cleaning-blade type; in particular, fur brush cleaning may be employed, or the cleaning may be performed at the same time as the developing.

Transfer Device

Examples of the transfer device 40 include known transfer chargers such as contact-type transfer chargers having a belt, a roller, a film, or a rubber blade and scorotron or corotron transfer chargers in which corona discharge is utilized.

Intermediate Transfer Body

The intermediate transfer body 50 is, for instance, in the form of a belt (intermediate transfer belt) containing a semi-conductive polyimide, polyamide imide, polycarbonate, polyarylate, polyester, or rubber. The intermediate transfer body may be in the form other than a belt, such as a drum.

Figure 3:
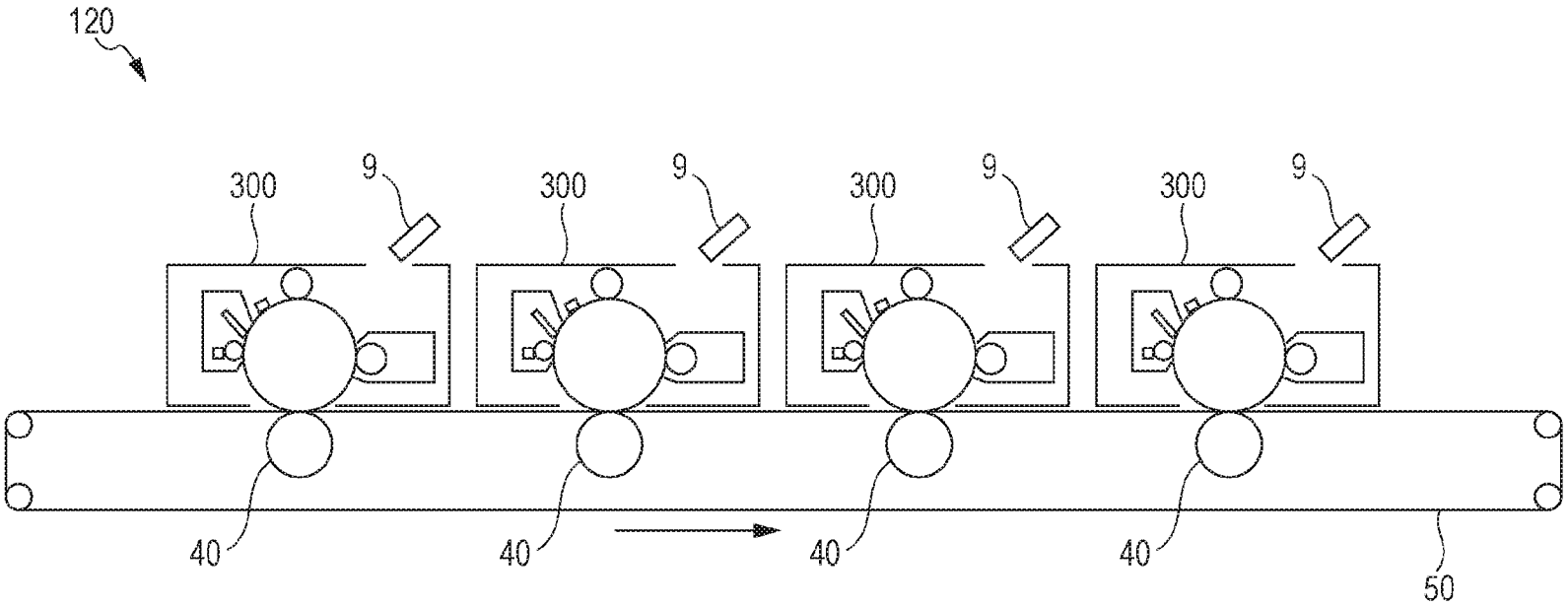
FIG. 3 schematically illustrates another example of the structure of the image forming apparatus according to the second exemplary embodiment.

FIG. 3 schematically illustrates another example of the structure of the image forming apparatus according to the second exemplary embodiment.

An image forming apparatus 120 illustrated in FIG. 3 is a tandem-type multicolor image forming apparatus including four process cartridges 300. In the image forming apparatus 120, the four process cartridges 300 are disposed in parallel so as to overlie the intermediate transfer body 50, and one electrophotographic photoreceptor serves for one color. Except that the image forming apparatus 120 is a tandem type, it has the same structure as the image forming apparatus 100.

EXAMPLES

Examples of the exemplary embodiments of the invention will now be described, but the exemplary embodiments of the invention are not limited thereto.

Example 1

With 100 parts by mass of zinc oxide (trade name: MZ 300, manufactured by TAYCA CORPORATION), 10 parts by mass of a toluene solution of 10-mass % N-2-(aminoethyl)-3-aminopropyltriethoxysilane as a silane coupling agent and 200 parts by mass of toluene are mixed. Then, the mixture is stirred and subsequently refluxed for two hours. The toluene is distilled off under reduced pressure at 10 mmHg, and the resulting product is baked at 135° C. for 2 hours for treatment of the surface of the zinc oxide with the silane coupling agent.

Then, 33 parts by mass of the surface-treated zinc oxide is mixed with 6 parts by mass of blocked isocyanate (trade name: Sumidur 3175, manufactured by Sumitomo Bayer Urethane Co., Ltd.), 1 part by mass of a compound represented by Structural Formula (AK-1), and 25 parts by mass of methyl ethyl ketone over 30 minutes. Then, 5 parts by mass of a butyral resin (trade name: S-LEC BM-1, manufactured by SEKISUI CHEMICAL CO., LTD.), 3 parts by mass of silicone balls (trade name: Tospearl 120 manufactured by Momentive Performance Materials Inc.), and 0.01 part by mass of a leveling agent that is a silicone oil (trade name: SH29PA, manufactured by Dow Corning Toray Silicone Co., Ltd.) are added to the mixture. The resulting mixture is subjected to dispersion with a sand mill for three hours to yield a coating liquid used for forming an undercoat layer.

The coating liquid used for forming an undercoat layer is applied onto an aluminum substrate having a diameter of 47 mm, a length of 357 mm, and a thickness of 1 mm by dip coating and dried and cured at 180° C. for 30 minutes to form an undercoat layer having a thickness of 25 μm.

(AK-1)

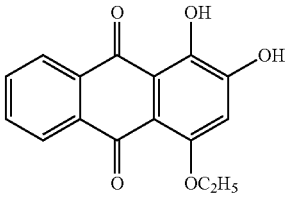

A charge-generating material that is a mixture of a type-V hydroxygallium phthalocyanine pigment having diffraction peaks at Bragg angles (20±0.2°) of at least 7.3°, 16.0°, 24.9°, and 28.0° in an X-ray diffraction spectrum using CuKα characteristic X-rays (maximum peak wavelength in an optical absorption spectrum at a wavelength ranging from 600 nm to 900 nm: 820 nm, average particle size: 0.12 μm, maximum particle size: 0.2 μm, specific surface area: 60 $m^2/g$), a binder resin that is a vinyl chloride-vinyl acetate copolymer resin (trade name: VMCH, manufactured by Nippon Unicar Company Limited), and n-butyl acetate is put into a glass bottle having a capacity of 100 mL together with glass beads having a diameter of 1.0 mm at a filling rate of 50%; and the content is dispersed with a paint shaker for 2.5 hours to produce a coating liquid used for forming a charge-generating layer. The hydroxygallium phthalocyanine pigment content in the mixture of the hydroxygallium phthalocyanine pigment, the vinyl chloride-vinyl acetate copolymer resin, and the n-butyl acetate is adjusted to be 55.0 vol %; and the solid content in the dispersion is adjusted to be 6.0 mass %. The content is calculated on the basis that the specific gravity of the hydroxygallium phthalocyanine pigment is 1.606 $g/cm^3$ and that the specific gravity of the vinyl chloride-vinyl acetate copolymer resin is 1.35 $g/cm^3$.

The coating liquid used for forming a charge-generating layer is applied onto the undercoat layer by dip coating and then dried at 100° C. for 5 minutes to form a charge-generating layer having a thickness of 0.20 μm.

Then, 32.0 parts by mass of a charge-transporting material that is example compound (CT1-2) of the benzidine charge-transporting material and 60.0 parts by mass of a binder resin that is a bisphenol-Z-type polycarbonate resin (homopolymeric polycarbonate resin of bisphenol Z, viscosity average molecular weight: 40,000) are dissolved in a mixed solvent of 30 parts by mass of tetrahydrofuran (THF) as a good solvent and 420.0 parts by mass of methyl ethyl ketone (MEK) as a poor solvent to yield a coating liquid used for forming a charge-transporting layer.

The coating liquid used for forming a charge-transporting layer is applied onto the charge-generating layer by dip coating and dried at 150° C. for 40 minutes to form a charge-transporting layer having a thickness of 34 μm. Through this process, an electrophotographic photoreceptor has been produced.

Examples 2 to 6 and Comparative Examples 1 to 3

Electrophotographic photoreceptors are produced as in Example 1 except that the types and amounts of the charge-transporting material, good solvent, and poor solvent are changed as shown in Table 1.

Evaluations

The electrophotographic photoreceptors produced in Examples and Comparative Examples are evaluated as follows. Average Particle Size of Crystals of Charge-transporting Material in Charge-transporting Layer The average particle size of the crystals of the charge-transporting material in the charge-transporting layer of the photoreceptor produced in each of Examples and Comparative Examples is measured in the above-mentioned manner.

MD-1 Hardness of Charge-Transporting Layer

A measurement sample is taken out of the charge-transporting layer of the photoreceptor produced in each of Examples and Comparative Examples. The measurement sample has a thickness of 40 m and a shape of 10-mm square.

The MD-1 hardness of the charge-transporting layer is measured under the following conditions.

Measurement apparatus: MD-1 capa type-A manufactured by KOBUNSHI KEIKI CO., LTD.

Measurement conditions: a measurement mode is a normal mode; a timer is set for 2 seconds; measurement points are the points spaced apart from the two ends of the photoreceptor by 50 mm in the axial direction and the center therebetween, namely 3 points in total; and the average of the results at the 3 measurement points is defined as the hardness.

Occurrence of Cracks in Charge-Transporting Layer

The photoreceptors produced in Examples and Comparative Examples are individually attached to an electrophotographic image forming apparatus prepared by modifying DocuCentre-IV C5570 (manufactured by Fuji Xerox Co., Ltd.).

A chart having an image density of 5% is continuously formed on 200,000 sheets of A4 paper and output with this apparatus. Then, the photoreceptor is detached from the apparatus and visually observed to see if the charge-transporting layer has cracks.

Degree of Wear of Charge-Transporting Layer

The photoreceptors produced in Examples and Comparative Examples are individually attached to an electrophotographic image forming apparatus prepared by modifying DocuCentre-IV C5570 (manufactured by Fuji Xerox Co., Ltd.).

A chart having an image density of 5% is continuously formed on 200,000 sheets of A4 paper and output with this apparatus. Then, the thickness of the charge-transporting layer of the photoreceptor is measured. The thickness of the charge-transporting layer is measured with an eddy-current coating thickness meter (manufactured by FISCHER INSTRUMENTS K.K.). The difference in the thickness (μm) of the charge-transporting layer between before and after the continuous output of the 200,000 sheets is determined.

Image Density

The photoreceptors produced in Examples and Comparative Examples are individually attached to an electrophotographic image forming apparatus prepared by modifying DocuCentre-IV C5570 (manufactured by Fuji Xerox Co., Ltd.).

A half-tone image (cyan) having an image density of 50% is formed on the entire surface of a sheet of A3 paper and output with this apparatus.

The output half-tone image is observed. The difference between the intended image density and the actual image density of the formed image is determined and evaluated on the basis of the following criteria. The formation and output of the image is carried out at 28° C. and 85% RH.

A: Difference in image density is 0.2 or less

B: Difference in image density is greater than 0.2 and 0.3 or less

C: Difference in image density is greater than 0.3 Table 1 shows the details of Examples and Comparative Examples. The abbreviations in Table 1 are as follows.

CT1-2: example compound (CT1-2) of the benzidine charge-transporting material that is a charge-transporting material represented by Structural Formula (CT1A)

(CT1A)

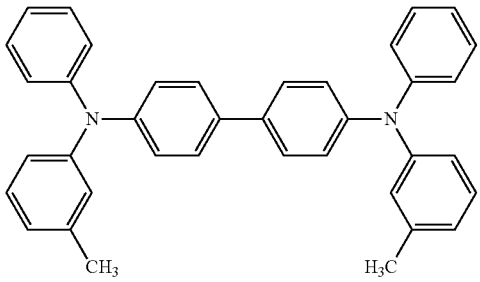

TNF: trinitrofluorenone
TFH: tetrahydrofuran
MEK: methyl ethyl ketone
MIBK: methyl isobutyl ketone

TABLE 1

| | Charge-transporting layer | | | | | | | Average | Results of evaluations | | | |
|---|---|---|---|---|---|---|---|---|---|---|---|---|
| | Charge-transporting material 1 | | Good solvent | | Poor solvent | | | | | | | |
| | Type | Part by mass | Type | Part by mass (amount) | Type | Part by mass (amount) | Residual amount (ppm) | particle size of crystals of charge-transporting material (um) | MD-1 hardness of charge-transporting layer | Cracks in charge-transporting layer | Image density | Degree of wear of charge-transporting layer (μm) |
| Example 1 | CT1-2 | 32.0 | THF | 30 | MEK | 420.0 | 4800 | 4.8 | 76.8 | None | A | 7.2 |
| Example 2 | CT1-2 | 32.0 | THF | 30 | MEK | 50.0 | 200 | 0.5 | 73.2 | None | A | 8.8 |
| Example 3 | CT1-2 | 32.0 | THF | 30 | MEK | 380.0 | 4200 | 3.1 | 75.5 | None | A | 7.8 |
| Example 4 | CT1-2 | 32.0 | THF | 30 | MIBK | 340.0 | 1800 | 2.9 | 75.3 | None | A | 7.9 |
| Example 5 | CT1-2 | 32.0 | THF | 30 | MEK | 190.0 | 1500 | 1.5 | 74.2 | None | B | 8.4 |
| Example 6 | TNF | 32.0 | THF | 30 | MIBK | 180.0 | 700 | 1.3 | 74.04 | None | B | 8.4 |
| Comparative Example 1 | TNF | 32.0 | THF | 30 | MEK | 30 | 20 | 0.06 | 71.2 | None | C | 12.2 |
| Comparative Example 2 | CT1-2 | 32.0 | THF | 30 | MEK | 640.0 | 6800 | 6.9 | 78.52 | Occurred | C | 5.8 |
| Comparative Example 3 | CT1-2 | 32.0 | THF | 340.0 | — | — | — | 0 | 70.9 | None | C | 12.5 |

As is obvious from the results, the wear of the charge-transporting layer as the outermost layer and the occurrence of cracks are reduced more in the photoreceptors of Examples than in the photoreceptors of Comparative Examples.

In the photoreceptors of Examples, the occurrence of uneven image density is reduced, and electrical properties are good over time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

a charge-generating layer disposed on the conductive substrate; and a charge-transporting layer as an outermost layer disposed on the charge-generating layer and comprising a binder resin and a charge-transporting material, wherein the average particle size of a crystal of the charge-transporting material is approximately from 0.1 μm to 5.0 μm, and wherein the charge-transporting layer comprises a poor solvent for the charge-transporting material, wherein the poor solvent comprises dialkylketone.

2. The electrophotographic photoreceptor according to claim 1, wherein the dialkylketone is dialkylketone of which the two alkyl groups each have from 1 to 6 carbon atoms.

3. The electrophotographic photoreceptor according to claim 1, wherein the charge-transporting material comprises a charge-transporting material represented by General Formula (CT1)

(CT1)

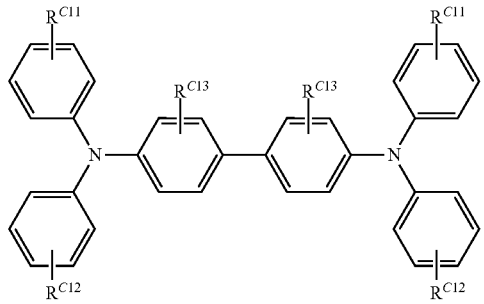

(where $R^{C11}$, $R^{C12}$, and $R^{C13}$ each independently represent a hydrogen atom, a halogen atom, an alkyl group having from 1 to 10 carbon atoms, an alkoxy group having from 1 to 10 carbon atoms, or an aryl group having from 6 to 10 carbon atoms).

4. The electrophotographic photoreceptor according to claim 3, wherein in the charge-transporting material represented by General Formula (CT1), $R^{C11}$ and $R^{C13}$ each represent a hydrogen atom, and $R^{C12}$ represents an alkyl group having from 1 to 10 carbon atoms.

5. The electrophotographic photoreceptor according to claim 4, wherein the charge-transporting material represented by General Formula (CT1) comprises a charge-transporting material represented by Structural Formula (CT1A)

(CT1A)

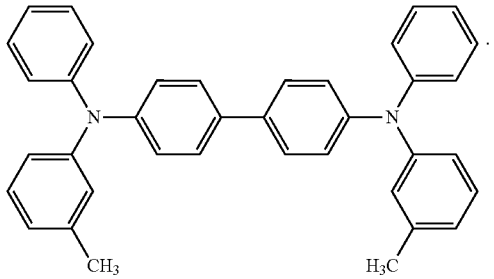

6. An electrophotographic photoreceptor comprising:

a conductive substrate; and a single-layer photosensitive layer as an outermost layer disposed on the conductive substrate and containing a binder resin, a charge-generating material, and a charge-transporting material, wherein the average particle size of a crystal of the charge-transporting material is approximately from 0.1 μm to 5.0 μm, wherein the single-layer photosensitive layer comprises a poor solvent for the charge-transporting material, wherein the poor solvent comprises dialkylketone.

7. A process cartridge comprising the electrophotographic photoreceptor according to claim 1, wherein the process cartridge is removably attached to an image forming apparatus.

8. An image forming apparatus comprising:

the electrophotographic photoreceptor according to claim 1;

a charging unit that charges a surface of an electrophotographic photoreceptor;

an electrostatic latent image forming unit that forms an electrostatic latent image on the charged surface of the electrophotographic photoreceptor;

a developing unit that develops the electrostatic latent image on the surface of the electrophotographic photoreceptor with a developer containing toner to form a toner image; and a transfer unit that transfers the toner image to the surface of a recording medium.

9. The electrophotographic photoreceptor according to claim 1, wherein a mass ratio of a solvent used in preparation of the charge-transporting layer to the poor solvent is greater than or equal to 0/10 and less than or equal to 3/7.

10. The electrophotographic photoreceptor according to claim 6, wherein a mass ratio of a solvent used in preparation of the charge-transporting layer to the poor solvent is greater than or equal to 0/10 and less than or equal to 3/7.

11. A method of forming an electrophotographic photoreceptor comprising:

providing a substrate;

forming a charge-generating layer on the substrate;

dissolving a charge-transporting material and a binder resin in a mixed solvent including a good solvent and a poor solvent of the charge-transporting material, wherein a mass ratio of the good solvent to the poor solvent is greater than or equal to 0/10 and less than or equal to 3/7; and forming a charge-transporting layer including the charge-transporting material, the binder resin, and a residual portion of the poor solvent.

12. The electrophotographic photoreceptor according to claim 1, wherein the poor solvent is residually present in the charge transporting layer after its formation.

13. The electrophotographic photoreceptor according to claim 6, wherein the poor solvent is residually present in the charge transporting layer after its formation.

14. The method according to claim 11, wherein the poor solvent is residually present in the charge transporting layer after its formation.

* * * * *